US007273538B2

(12) United States Patent
Chen et al.

(10) Patent No.: US 7,273,538 B2
(45) Date of Patent: Sep. 25, 2007

(54) SURFACE MOUNTABLE LAMINATED CIRCUIT PROTECTION DEVICE AND METHOD OF MAKING THE SAME

(75) Inventors: Rei-Yian Chen, Hsinchu Hsien (TW); Chih-Yi Chang, Changhua Hsien (TW); Tung-Hsiang Liu, Taoyuan Hsien (TW)

(73) Assignee: Protectronics Technology Corporation, Taoyuan (TW)

( * ) Notice: Subject to any disclaimer, the term of this patent is extended or adjusted under 35 U.S.C. 154(b) by 740 days.

(21) Appl. No.: 10/671,041

(22) Filed: Sep. 25, 2003

(65) Prior Publication Data

US 2004/0069645 A1 Apr. 15, 2004

Related U.S. Application Data

(62) Division of application No. 10/096,543, filed on Mar. 13, 2002, now Pat. No. 6,686,827.

(30) Foreign Application Priority Data

Mar. 28, 2001 (TW) ..... 90107277 A

(51) Int. Cl.
*C25C 28/00* (2006.01)
*C25D 5/02* (2006.01)

(52) U.S. Cl. ..... 205/191; 205/125

(58) Field of Classification Search ..... 205/191, 205/125

See application file for complete search history.

(56) References Cited

U.S. PATENT DOCUMENTS 5,831,510 A * 11/1998 Zhang et al. ..... 338/22 R
5,852,397 A 12/1998 Chan et al. ..... 338/22 R
5,940,958 A 8/1999 Shaw, Jr. et al. ..... 29/612
6,023,403 A 2/2000 McGuire et al. ..... 361/106
6,040,755 A 3/2000 Abe et al. ..... 338/22 R
6,242,997 B1 6/2001 Barrett et al. ..... 338/22 R
6,311,390 B1 11/2001 Abe et al. ..... 29/612
6,400,251 B1 6/2002 Abe et al. ..... 338/22 R
6,830,839 B1 12/2004 Backer et al. ..... 428/701
2002/0050914 A1 * 5/2002 Chiang et al. ..... 338/22 R
2002/0125982 A1 9/2002 Swensen et al.
2002/0130757 A1 9/2002 Huang et al.

FOREIGN PATENT DOCUMENTS

TW 419678 4/1998

* cited by examiner

*Primary Examiner*—Edna Wong
(74) *Attorney, Agent, or Firm*—Ladas & Parry LLP

(57) ABSTRACT

A surface mountable laminated circuit protection device comprises a first metal layer including a first unit and a second unit, a first insulating layer disposed on the first metal layer, and a second metal layer disposed on the first insulated layer. There is also a composite electroplated layer containing carbon black disposed on the second metal layer, and a first conductive composite material having positive temperature coefficient (PTC) characteristics disposed on the composite electroplated layer containing carbon black. Above the first conductive composite material is a third metal layer. Furthermore, there is a first conducting mechanism for conducting the first metal layer and the second metal to each other; and a second conducting mechanism for conducting the third metal layer and the first metal layer to each other. The application of double-sided metal foil clad substrate simplifies the production process of the protection device and improves its structural strength and dimensional stability.

11 Claims, 9 Drawing Sheets

SURFACE MOUNTABLE LAMINATED CIRCUIT PROTECTION DEVICE AND METHOD OF MAKING THE SAME

CROSS-REFERENCE TO RELATED APPLICATIONS

The application is a division of application Ser. No. 10/096,543, originally filed on Mar. 13, 2002, now U.S. Pat. No. 6,686,827, and the disclosure of which is incorporated herein by reference.

BACKGROUND OF THE INVENTION (A) Field of the Invention

The present invention relates to a surface mountable laminated circuit protection device and method of making the same, in particular, to a surface mountable laminated circuit protection device having positive temperature coefficient (PTC) characteristics and the method of making the same.

(B) Description of Related Art

PTC devices are already widely used in various fields, such as temperature detection, security control, temperature compensation, and so on. In the past, the thermistor device was generally made from ceramic material. However, the ceramic material was formed at high temperatures, in most cases more than 900° C., thus rendering the energy consumption enormous, and making the production process very complex. Subsequently, a thermistor device made from a polymeric substrate was developed. As the temperature for manufacturing a thermistor device made from a polymeric substrate is under 300° C., its molding and manufacturing is easier, energy consumption is less, the production process is simpler, and production cost is lower. As a result, this kind of thermistor device has become more and more popular.

U.S. Pat. No. 5,852,397 discloses a polymeric composite material filled with a conductive filler to form a PTC circuit protection device. The polymeric composite material filled with a conductive filler having PTC characteristics is under a low resistance status at room temperature; when the current flowing through the polymeric composite material is too large, the temperature of the polymeric composite material reaches a certain switching temperature (Ts), and the resistance of the polymeric composite material filled with a conductive filler increases rapidly to prevent important devices in the circuit from being burnt down; this characteristic can be applied to the design of over-current protection devices and temperature switch devices. This phenomenon is due to the fact that the conductive filler particles in the polymeric composite material filled with the conductive filler are at continuous and conducting status at room temperature. When the temperature rises to above Ts, the volume of the resin in the polymeric composite material expands to an extent that makes the conductive filler particles in the polymeric composite material break down from a continuous status to a discontinuous status; the resistance of the PTC circuit protection device thus rises rapidly to break the current to achieve the objectives of over-current protection and temperature control switch. Various different materials are used as conductive filler, with the most common being carbon black.

U.S. Pat. No. 6,023,403 discloses a PTC laminated structure of a conductive composite material device that has a top metal foil layer, a bottom metal foil layer and a middle layer having PTC characteristics. Combined with a side-conducting mechanism and insulating material, it conducts the top and bottom metal electrodes of the conductive composite material having PTC characteristics to another side to form a surface mountable circuit protection device.

R.O.C. Patent Published No. 419,678 discloses a PTC laminated structure of a conductive composite material device that has a top metal foil layer, a bottom metal foil layer and a middle layer having PTC characteristics. It combines with a plated through hole conducting mechanism and applies an etching process to form a discontinuous cross-section on the top and bottom metal electrode layers for conducting the top and bottom metal electrodes of the conductive composite material having PTC characteristics to the same side, then applies more than two similar top and bottom metal electrodes, conducting PTC laminated structure, and insulating layer to form a parallel connected surface mountable circuit protection device.

Prior art mainly utilizes metal foil and conductive composite material elements having PTC characteristics to form a PTC laminated structure using the thermal laminating process, then performing electroplating process, etching process, plating through hole and lateral end point silver process. The mechanical strength of a PTC laminated structure formed by metal foil/conductive composite material device having PTC characteristics/metal foil is inadequate; it tends to wrap and become deformed during the processes mentioned on. When it comes to laminating with other PTC laminated structure, strengthened insulating material or metal electrode by thermal laminating process after circuits have been made, there is a problem with the accuracy of location correspondence between upper and lower layers.

Furthermore, prior art already uses carbon black to directly wedge to metal nodular protrusions; the geometric shapes of carbon black and of metal nodular protrusions are different, so the contact density is not very well. Meanwhile, the mobility of resin on the surface of carbon black is not good between carbon black and metal; sometimes it just adheres to the surface of the metal, thus increasing the resistance of the interface and affecting its functioning.

Moreover, the production method of prior art involves laminating metal foil and conductive composite material element having PTC characteristics by thermal laminating process first, and then proceeding with plating through hole process or lateral end-point silver process of passive device to conducting top and bottom metal electrodes, thus forming a circuit protection device. The conducting method between the internal electrodes of the circuit protection device is limited by this fabrication method.

SUMMARY OF THE INVENTION

An object of the present invention is to provide a process for manufacturing a surface mountable laminated circuit protection device, which utilizes a well-developed process used in printed circuit board (PCB) production during the process of the present invention to make the manufacturing of circuit protection devices easier.

Another object of the present invention is to provide a surface mountable laminated circuit protection device with better structural strength and dimensional stability.

Yet another object of the present invention is to provide a surface mountable laminated circuit protection device possessing symmetric structure, which can be processed on both sides at the same time to make manufacturing more convenient.

Still another object of the present invention is to provide a surface mountable laminated circuit protection device, which forms a fine contact between the metal and the conductive composite material to reduce the interfacial resistance between them and improve the functioning of the circuit protection device.

To achieve the objects described above, the present invention provides a surface mountable laminated circuit protection device comprising a first metal layer including a first unit and a second unit. A first insulating layer is disposed on the first metal layer, and a second metal layer is disposed on the first insulating layer. There is also a composite electroplated layer containing carbon black disposed on the second metal layer, and a first conductivity composite material layer having positive temperature coefficient (PTC) characteristics disposed on the composite electroplated layer containing carbon black; it is jointed to the second metal layer by means of a composite electroplated layer containing carbon black. Above the first conductivity composite material layer having PTC characteristics there is a third metal layer. Furthermore, there is a first conducting mechanism for conducting the second metal layer and the second unit of the first metal layer to each other, and a second conducting mechanism for conducting the third metal layer and the first unit of the first metal layer to each other.

Moreover, the present invention provides a method of making a surface mountable laminated circuit protection device, which uses the following steps: First, provide a double-sided foil clad substrate. The double-sided foil clad substrate comprising a first metal layer, a first insulating layer disposed on the first metal layer, and a second metal layer disposed on the first insulating layer. A plated through hole penetrates through the insulating layer for conducting the first metal layer and the second metal layer to each other; the first metal layer is further divided into a first unit and a second unit. A composite electroplating process with carbon black is proceeded to the second metal layer, it is to form a composite electroplated layer containing carbon black and metal on the surface of the second metal layer. A first conductivity composite material having PTC characteristics and a metal foil are then laminated in sequence onto the surface of the second metal layer using the thermal laminating process to join the first conductivity composite material having PTC characteristics and the second metal layer; the metal foil is further joined with the first conductivity composite material having PTC characteristics, thus forming a multi-layer laminated circuit structure, and the metal foil itself is taken as a third metal layer. An isolation step is proceeded to the third metal layer to make the third metal layer forming a third unit and a fourth unit. There is a first conducting mechanism set for conducting the third unit of the third metal layer and the first unit of the first metal layer to each other, and also a second conducting mechanism set for conducting the fourth unit of the third metal layer and the second unit of the first metal layer to each other.

In accordance with the description given on, the method of the present invention utilizes a double-sided metal foil clad substrate; it can directly fit in with the current well-developed process of printed circuit board to make the manufacturing of the laminated circuit protection device easier. Furthermore, the surface mountable laminated circuit protection device provided by the present invention uses a strengthened insulating layer to give the device better structural strength and better dimensional stability. In addition, a composite electroplated layer containing carbon black is formed on the metal layer; it can be tightly integrated with the first conductivity composite material having PTC characteristics, thus forming a fine joint for better functioning of the circuit protection device.

BRIEF DESCRIPTION OF THE DRAWINGS

The present invention is described below by way of examples with reference to the accompanying drawings which will make it easier for readers to understand the purpose, technical contents, characteristics and achievement of the present invention, wherein.

DETAILED DESCRIPTION OF THE INVENTION

Figure 1:
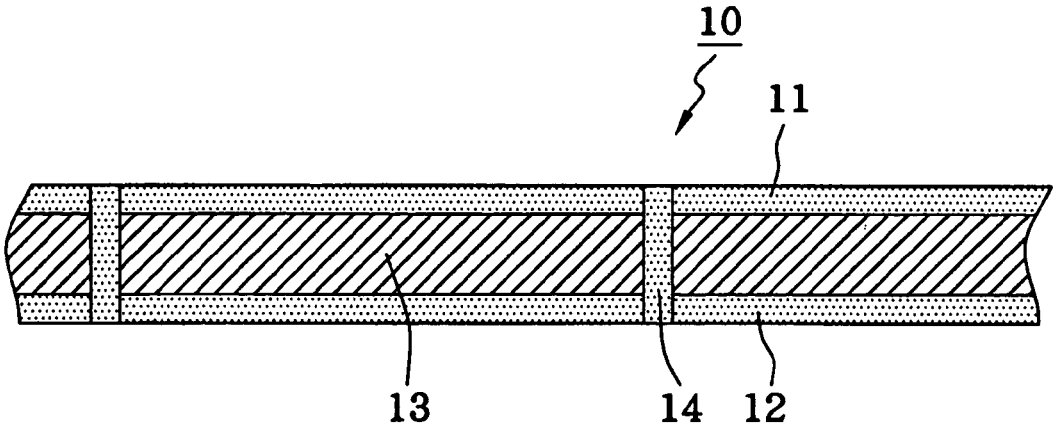
FIG. 1 is a cross-sectional view of a double-sided copper foil clad substrate of the first embodiment of the present invention.

FIG. 1 to FIG. 8 show the manufacturing procedure of the first embodiment of the present invention. As shown in FIG. 1, a double-sided metal foil clad substrate 10 is provided wherein the metal foil layer here is for conducting, thus any material that is conductive can be used. Currently, frequently used materials include copper foil, nickel foil, platinum foil, copper alloy, nickel alloy, or platinum alloy; the material used in this embodiment is copper foil. A conducting mechanism 14, which is a plated through hole 14 here, is set in the double-sided copper foil clad substrate 10 with the copper foil's thickness of 35 μm through a first (strengthened) insulating layer 13 for conducting a first metal layer 12 at bottom and a second metal layer 11 at top to each other.

Figure 2:
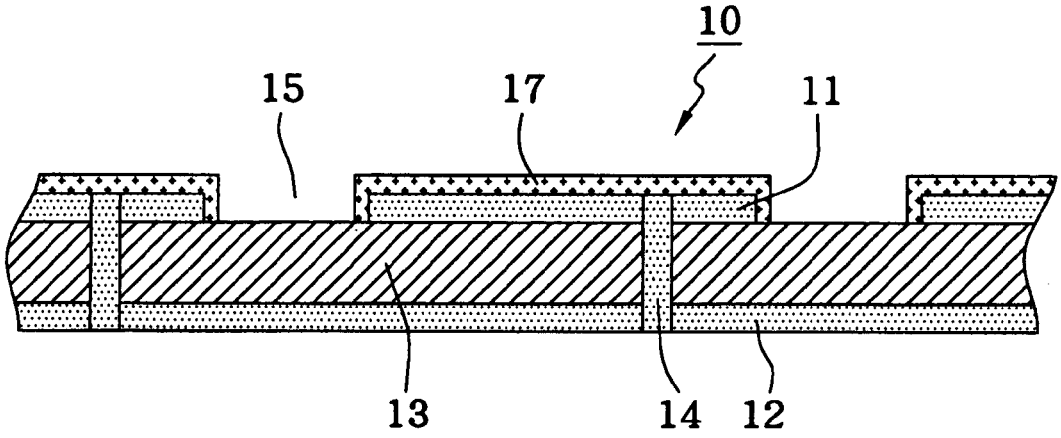
FIG. 2 is a cross-sectional view of another double-sided copper foil clad substrate of the first embodiment of the present invention.

As shown in FIG. 2, some parts of the second metal layer 11 are removed from the surface of the double-sided copper foil clad substrate 10 by an etching process to form non-metal areas 15, while the surface of the first metal layer 12 of the double-sided copper foil clad substrate 10 is protected by insulating tape; one then proceeds with a composite electroplating process with carbon black on the surface of the second metal layer 11 of the double-sided copper foil clad substrate 10. The solution for the composite electroplating process contains 40 grams of boric acid, 6 grams carbon black XC-72, and 30 grams of nickel (weight of nickel in nickel sulphamate solution) per 1 liter; temperature for the process is 35° C., current density is 3 A/dm$^2$, and electroplating time is 5 minutes. The degreasing solvent used in the cathode-degreasing step is made by adding 60 grams of degreasing agent to 1 liter of deionized water, and the concentration of sulfuric acid used for acid rinse is 10%. The utilization of carbon black XC-72 , produced by Cabot Co. of the U.S.A., contributes to forming a continuous porous composite electroplated layer 17 containing carbon black and metal on the surface of the second metal layer 11. The main constituents of the continuous porous metal-based composite material layer containing carbon black and metal on the surface of the second metal layer 11 are an electroplated metal, the primary aggregate of the carbon black, and the secondary aggregate of the carbon black. Electroplated metal adheres to the surface of the primary aggregate and the secondary aggregate of carbon black to form a porous structure.

Figure 3:
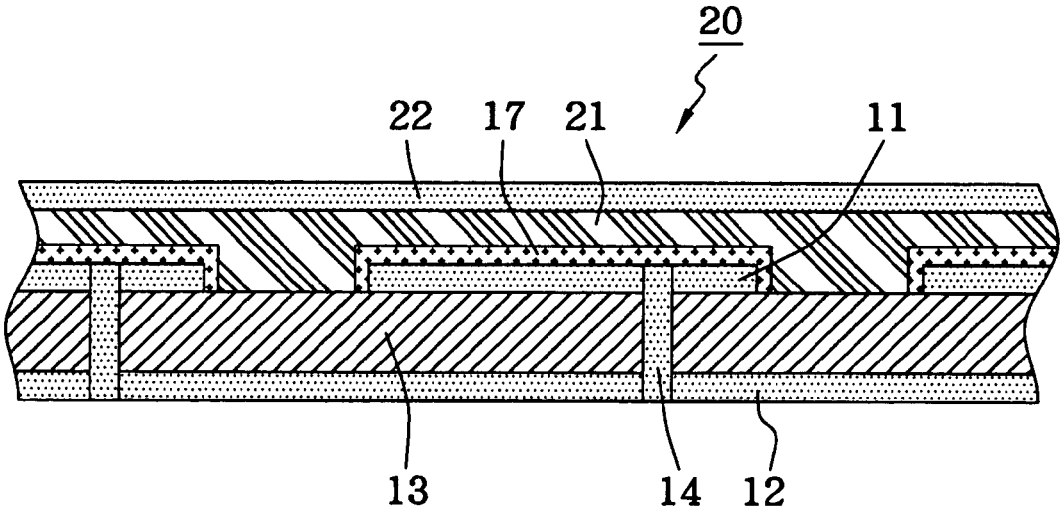
FIG. 3 is a cross-sectional view of a multi-layer laminated circuit structure of the first embodiment of the present invention.

Referring to FIG. 3, a conductive composite material 21 having PTC characteristics is jointed with the second metal layer 11 using the thermal laminating process. The conductive composite material 21 having PTC characteristics here is a conductive crystallized polymeric composite material filled with carbon black; it is made by mixing polyethylene Petrothene LB832 (a product of Equistar Co. of the U.S.A.) and carbon black Raven450 (a product of Columbian Co. of the U.S.A.) with a weight ratio of 1:1 together, then was incorporated into the Brabender mixer and mixed at 210° C. for 8 minutes. It is then thermal laminated to form a plaque-type conductivity composite material having PTC characteristics with a thickness of 0.5 mm, using a heated press at 175° C. In fact, besides polyethylene, the conductive composite material 21 can also be polypropylene, polyvinyl fluoride, or copolymers of these.

As described above, the composite electroplating process makes carbon black adhere to the surface of the second metal layer 11 to form a continuous porous structural layer, and both the second metal layer 11 and the conductive composite material 21 (a conductive crystallized polymeric composite material layer filled with carbon black) having PTC characteristics contain carbon black. The carbon black in the continuous porous structural layer on the surface of the second metal layer 11 and the conductive composite material 21 having PTC characteristics takes the primary aggregate as its basic form, stacking on each other in the resin substrate; in the case of a large quantity of carbon black, the primary aggregate of the carbon black stacks with each other to form secondary aggregate and become conductive continuous phase in the composite material. The continuous porous structure is constituted by metal, the primary aggregate of carbon black, and the secondary aggregate of carbon black, and because of the composite electroplating process, metal coheres to the surface of the secondary aggregate of the carbon black. Moreover, the continuous porous structure further forms the secondary aggregate of the carbon black with the conductivity composite material having PTC characteristics. The size of the primary aggregate of carbon black varies depending on the type of carbon black used, the average is between 0.1 μm to 0.5 μm.

From the point of view of micro-phenomena, due to the fact that the rough appearance of the continuous porous structure on the surface of the second metal layer 11 is similar to the microstructure of the carbon black conductive continuous phase of crystallized polymeric conductive composite material 21 filled with carbon black, the continuous porous structure on the surface of the second metal layer 11 and the carbon black conductive continuous phase in the crystallized polymeric conductive composite material 21 filled with carbon black together form a fine joint. Furthermore, the resin substrate that adheres to the surface of the carbon black in the conductive crystallized polymeric composite material filled with carbon black (which is the conductive composite material 21 having PTC characteristics) flows due to the heat during the thermal laminating process, and then permeates into the continuous porous structure of the second metal layer 11 formed by composite electroplating, so it does not affect route by which the carbon black conducts electricity in the conductive crystallized polymeric composite material filled with carbon black and directly contacts to the second metal layer 11. To make sure that the conductive composite material 21 of polyethylene forms a fine jointing strength with the second metal layer 11, the thickness of the composite electroplated layer 17 (continuous porous structure) must be greater than two times the average diameter of the primary aggregate of carbon black; that is to say, the thickness of the continuous porous structure must be greater than 0.2 μm.

The continuous porous structure of the composite electroplated layer 17 makes the second metal layer 11 and the conductive composite material 21 having PTC characteristics form a fine joint and causes them to have a lower interfacial resistance.

A metal foil, such as a nickel electroplated copper foil, which has been processed with a single face nodular process and has a thickness of 38 μm, is then employed as a third metal layer 22 of the present embodiment. There is already a metallic nodular layer (not shown) with a thickness in the range of 2 μm to 10 μm on the upper surface of the third metal layer 22; its function is to joint with the crystallized polymeric conductive composite material 21 filled with carbon black and contact with the conductive particles of carbon black in the crystallized polymeric conductive composite material 21 filled with carbon black to lower the interfacial resistance. Referring to FIG. 3, the rough face of the third metal layer 22, the surface of the second metal layer 11 of the double-sided copper foil clad substrate 10, and the conductive composite material 21 having PTC characteristics are laminated using the thermal laminating process at 175° C. for 10 minutes to form a multi-layer laminated circuit structure 20. The non-metal areas 15 on the double-sided copper foil clad substrate 10 are filled by the conductive composite material 21 having PTC characteristics which is softened and flows due to the heat. The multi-layer laminated circuit structure 20 is then irradiated by Co-60 with a dosage of 20 Mrad to make the polyethylene in the conductivity composite material cross-link so that it has a shape-memory property.

Figure 4:
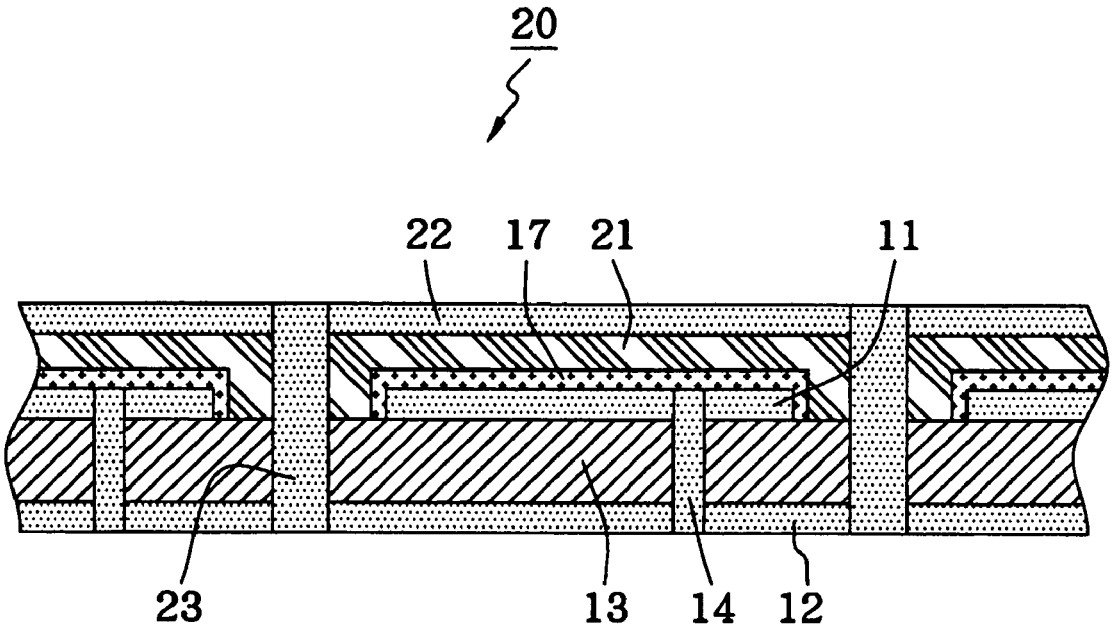
FIG. 4 is a cross-sectional view of a manufacturing process of a circuit protection device of the first embodiment of the present invention.

Referring to FIG. 4, a conducting mechanism is formed in the multi-layer laminated circuit structure 20 for conducting the third metal layer 22 and the first metal layer 12 to each other. In this embodiment, a plating through hole process is applied to produce a plated through hole 23 for conducting the third metal layer 22 and the first metal layer 12 to each other. Owing to the isolation of the conductive composite material 21 having PTC characteristics, the plated through hole 23 does not conduct to the second metal layer 11.

Figure 5:
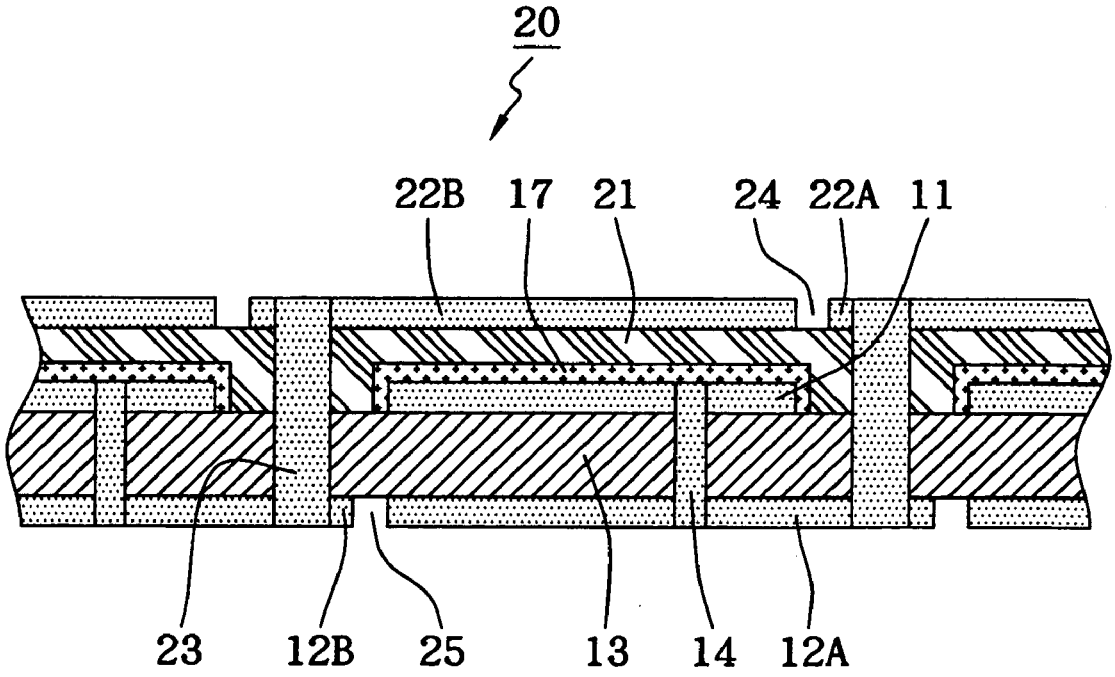
FIG. 5 is a cross-sectional view of another manufacturing process of a circuit protection device of the first embodiment of the present invention.

Referring to FIG. 5, the third metal layer 22 and the first metal layer 12 of the multi-layer laminated circuit structure 20 are etched to eliminate some parts of metal and thus form a top isolation trench 24 and a bottom isolation trench 25 that are not conductive, the etching process here is taken as an isolation process; furthermore, the third metal layer 22 is divided into a third unit 22A and a fourth unit 22B by the top isolation trench 24, and the first metal layer 12 is divided into a first unit 12A and a second unit 12B by the bottom isolation trench 25.

Figure 6:
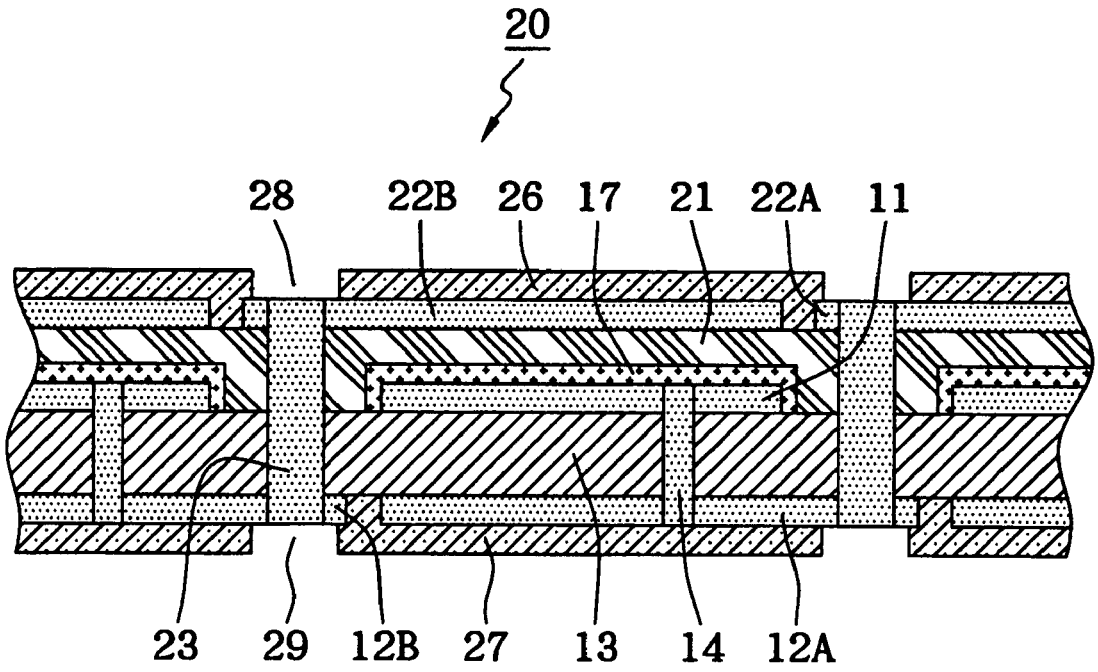
FIG. 6 is a cross-sectional view of yet another manufacturing process of a circuit protection device of the first embodiment of the present invention.
Figure 7:
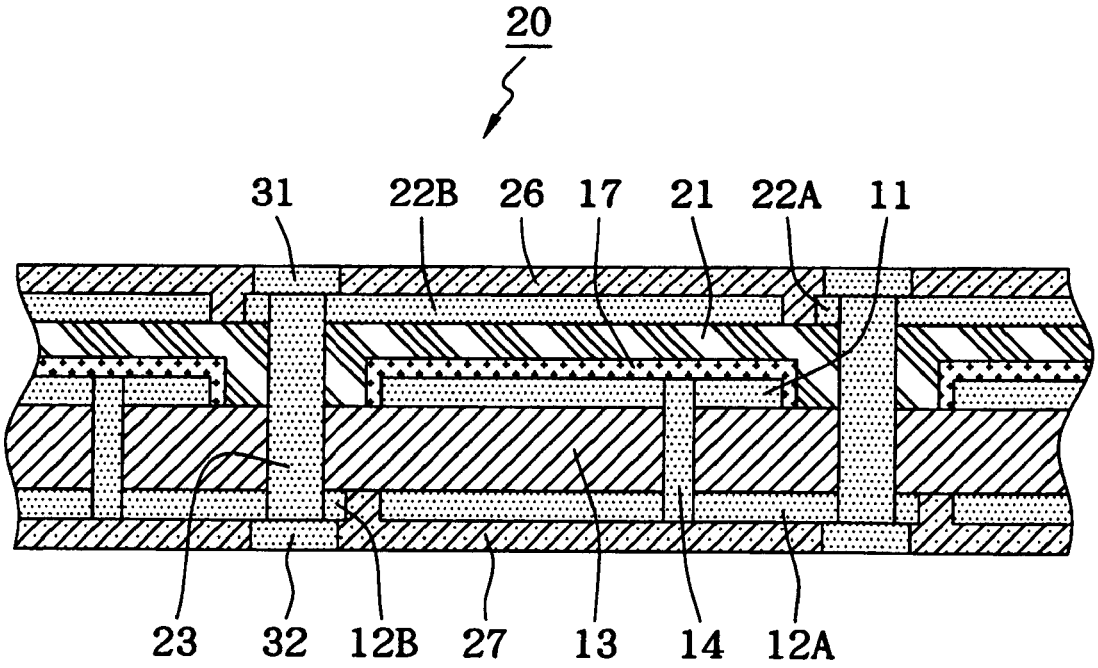
FIG. 7 is a cross-sectional view of still another manufacturing process of a circuit protection device of the first embodiment of the present invention.

Referring to FIG. 6, except for the positions of the uppermost end electrode 28 and the bottommost end electrode 29 on the surface of the third metal layer 22 and the first metal layer 12 of the multi-layer laminated circuit 20 respectively, all the other areas including the top isolation trench 24 and the bottom isolation trench 25 are coated with an insulating paint to form a top insulating layer 26 and a bottom insulating layer Referring to FIG. 7, a first end electrode 31 and a second end electrode 32 that can be welded are formed at the position of the uppermost end electrode 28 and the bottommost end electrode 29 by screen printing with tin paste or electroplating tin and lead. After accomplishing all the processes described above, the multi-layer laminated circuit structure 20 is diced from the middle position of the plated through hole 23 using a diamond knife.

Figure 8:
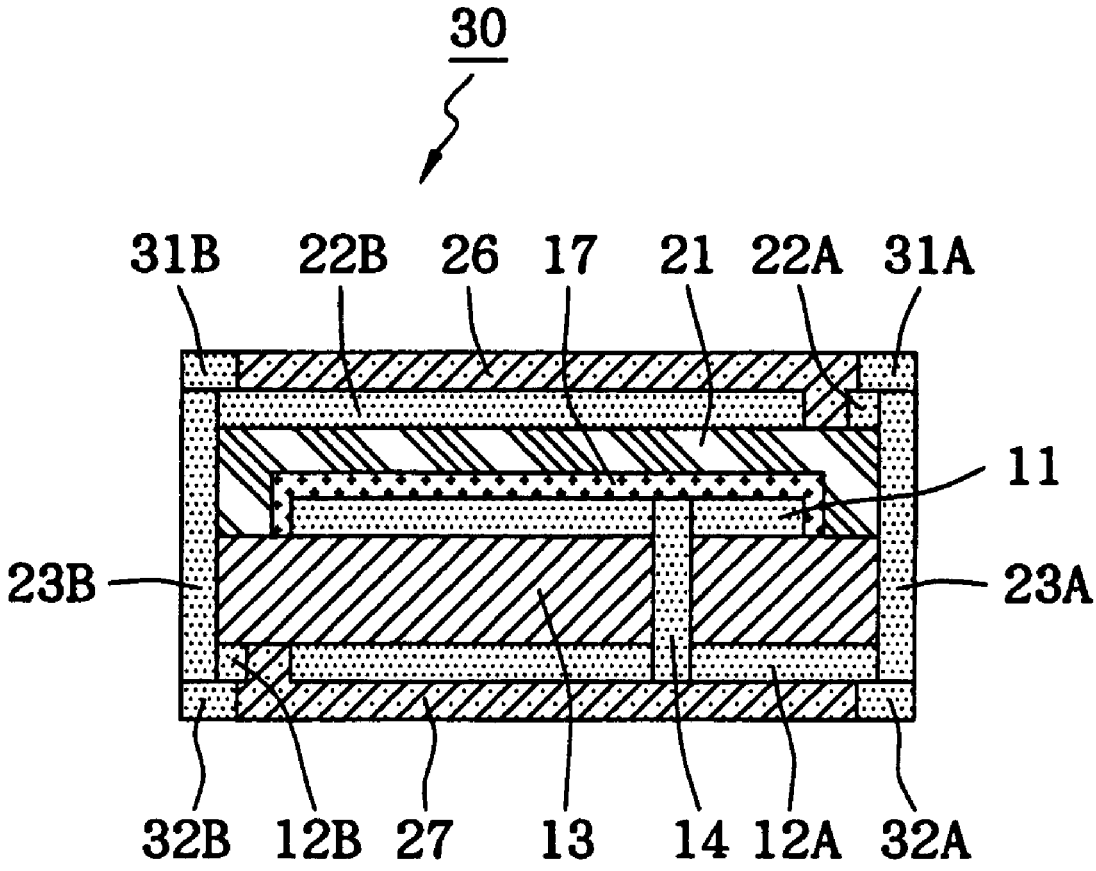
FIG. 8 is a circuit protection device of the first embodiment of the present invention.

Referring to FIG. 8, individual laminated circuit protection devices 30 are obtained after dicing. The uppermost first end electrode 31A and uppermost second end electrode 31B conduct to the bottommost first end electrode 32A and bottommost second end electrode 32B by utilizing a first plated through hole 23A and a second plated through hole 23B (both are taken to constitute substrate-conducting units) respectively.

For people skilled in the art, the first plated through hole 23A and the second plated through hole 23B can be replaced easily by the lateral end-point silver of a conventional passive device.

Figure 9:
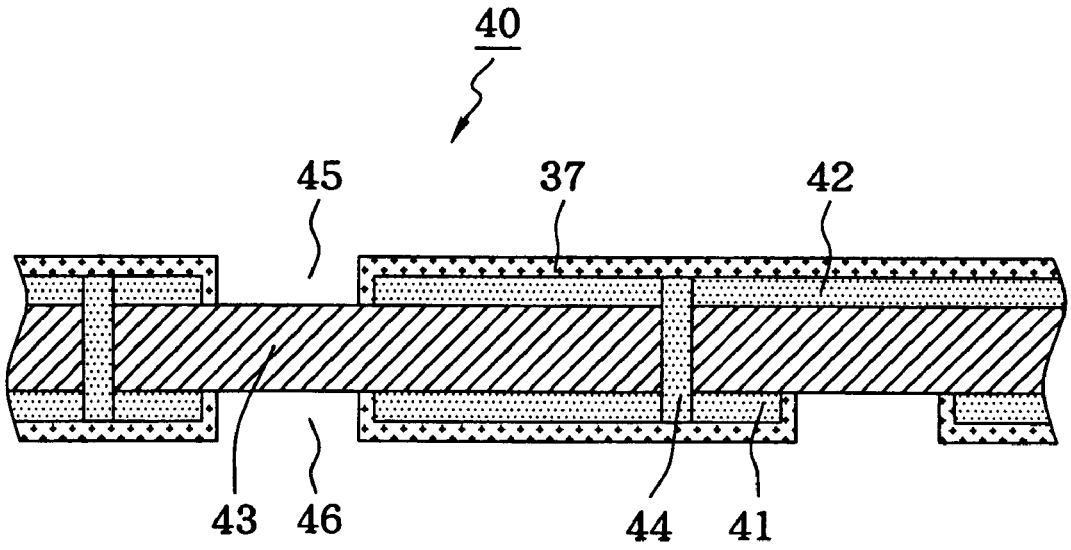
FIG. 9 is a cross-sectional view of a double-sided copper foil clad substrate of a second embodiment of the present invention.

FIG. 9 to FIG. 16 show the second embodiment of the present invention. As shown in FIG. 9, the double-sided copper foil clad substrate 40 used here is the same as the one used in the first embodiment. The copper foil clad substrate 40 has a plated through hole 44 for conducting a first metal layer 41 and a second metal layer 42. The first metal layer 41 and the second metal layer 42 of the double-sided copper foil clad substrate 40 are etched to eliminate some parts of metal and thus form a top non-metal area 45 and a bottom non-metal area 46.

A composite electroplating process with carbon black is carried out to form a composite electroplated layer 37 on the surface of the first metal layer 41 and the second metal layer 42, and the same electroplating parameters and conditions are applied.

Figure 10:
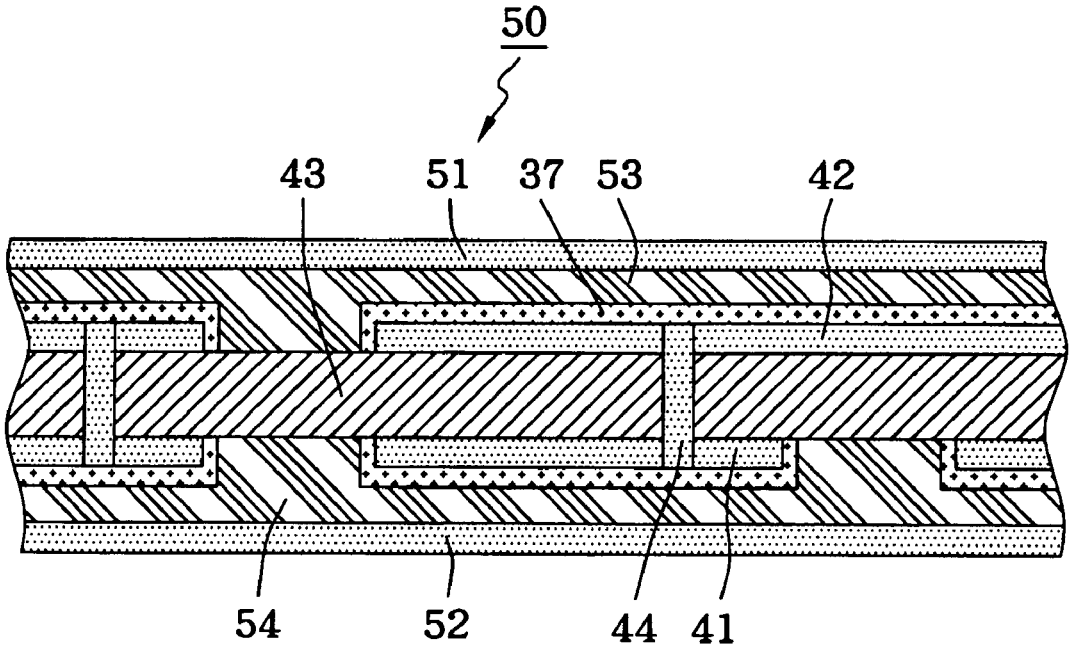
FIG. 10 is a cross-sectional view of a multi-layer laminated circuit structure of the second embodiment of the present invention.

Referring to FIG. 10, a nickel electroplated copper foil, which has been processed with a single face nodular process and has a thickness of 38 μm is employed as the uppermost metal electrode 51 and the bottommost metal electrode 52 of the present embodiment. The rough face of the nickel electroplated copper foil, the double-sided copper foil clad substrate 40, a top conductive composite material 53 having PTC characteristics at its top layer, and a bottom conductive composite material 54 having PTC characteristics at its bottom layer are laminated using the thermal laminating process at 175° C. for 10 minutes to form a multi-layer laminated circuit structure 50. The top non-metal area 45 and the bottom non-metal area 46 of the double-sided copper foil clad substrate 40 are fully filled by the top conductive composite material 53 and the bottom conductive composite material 54 which are softened and flow due to the heat, respectively. The multi-layer laminated circuit structure 50 is then irradiated by Co-60 with a dosage of 20 Mrad to make the polyethylene in the conductive composite materials 53 and 54 cross-link and thus have the shape-memory property.

Figure 11:
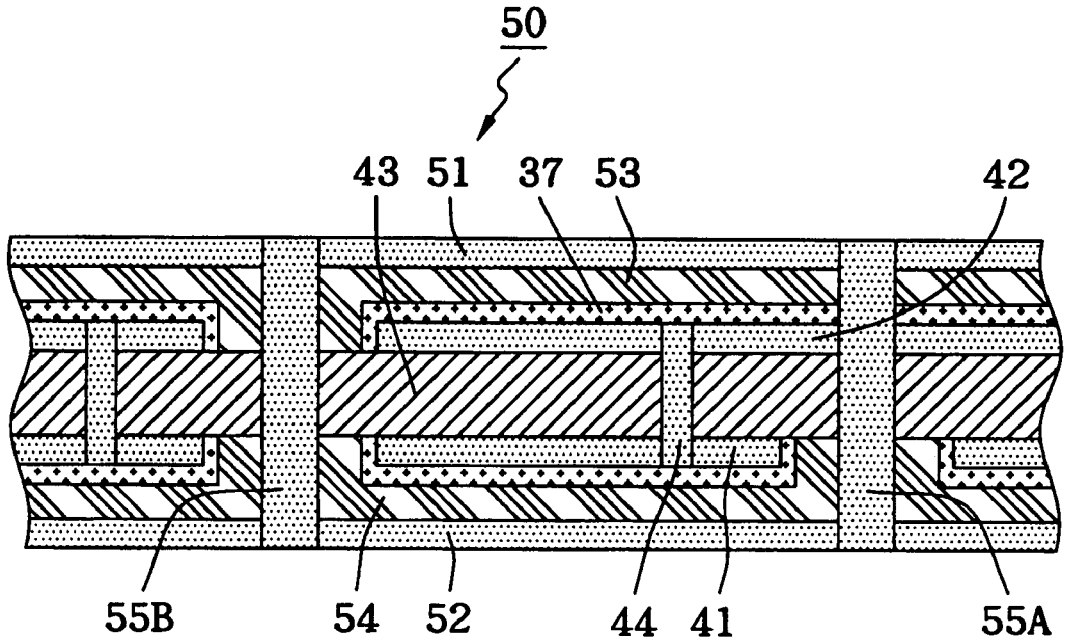
FIG. 11 is a cross-sectional view of a manufacturing process of a circuit protection device of the second embodiment of the present invention.

Referring to FIG. 11, a plated through hole process is carried out to the multi-layer laminated circuit structure 50 to conduct the uppermost metal electrode 51, the second metal layer 42 of the double-sided copper foil clad substrate, and the bottommost metal electrode 52 by a first plated through hole 55A; this process also makes the uppermost metal electrode 51 and the bottommost metal electrode 52 conduct to each other by a second plated through hole 55B. Nevertheless, the first plated through hole 55A is not connected and thus conducts to the first metal layer 41 of the double-sided copper foil clad substrate due to the isolation of the conductive composite material 54, and the second plated through hole 55B is not connected and thus conducts to the first metal layer 41 and the second metal layer 42 of the double-sided copper foil clad substrate 40 due to the isolation of the conductive composite materials 54 and 53, respectively.

Figure 12:
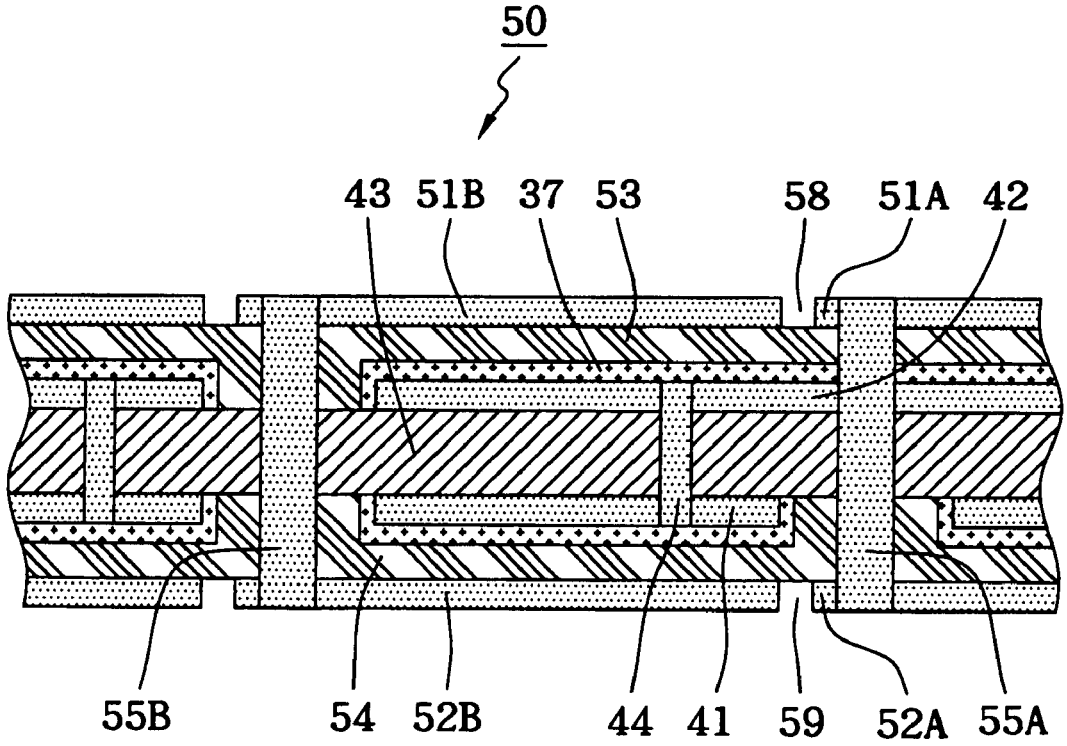
FIG. 12 is a cross-sectional view of another manufacturing process of a circuit protection device of the second embodiment of the present invention.

Referring to FIG. 12, the uppermost metal electrode 51 and the bottommost metal electrode 52 of the multi-layer laminated circuit structure 50 are etched to eliminate some parts of metal electrode and thus form an uppermost isolation trench 58 and an bottommost isolation trench 59 that are not conductive; furthermore, the uppermost metal electrode 51 is divided into a first unit 51A of the uppermost metal electrode 51 and a second unit 51B of the uppermost metal electrode 51 by the uppermost isolation trench 58, and the bottommost metal electrode 52 is divided into a third unit 52A of the bottommost metal electrode 52 and a fourth unit 52B of the bottommost metal electrode 52 by the bottommost isolation trench 59.

Figure 13:
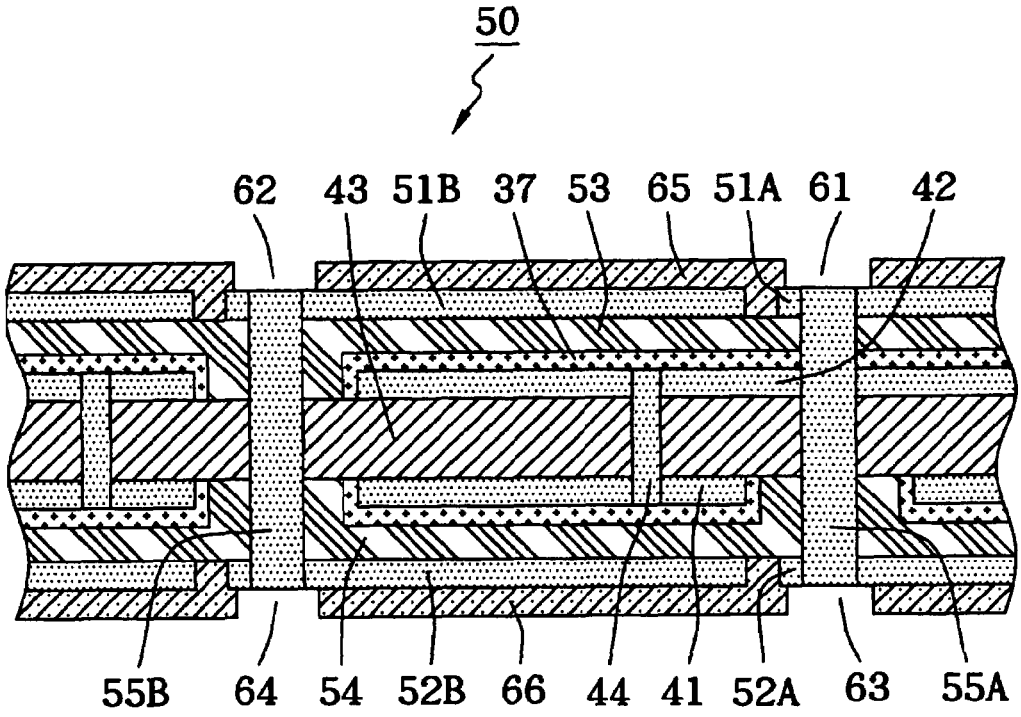
FIG. 13 is a cross-sectional view of yet another manufacturing process of a circuit protection device of the second embodiment of the present invention.

Referring to FIG. 13, except for the positions of the first position 61 of the uppermost end electrode, the second position 62 of the uppermost end electrode, the first position 63 of a bottommost end electrode, and the second position 64 of a bottommost end electrode on the surface of the uppermost metal electrode 51 and the bottommost metal electrode 52 respectively, all the other areas including the uppermost isolation trench 58 and the bottommost isolation trench 59 are coated with an insulating paint to form a top insulating layer 65 and a bottom insulating layer 66.

Figure 14:
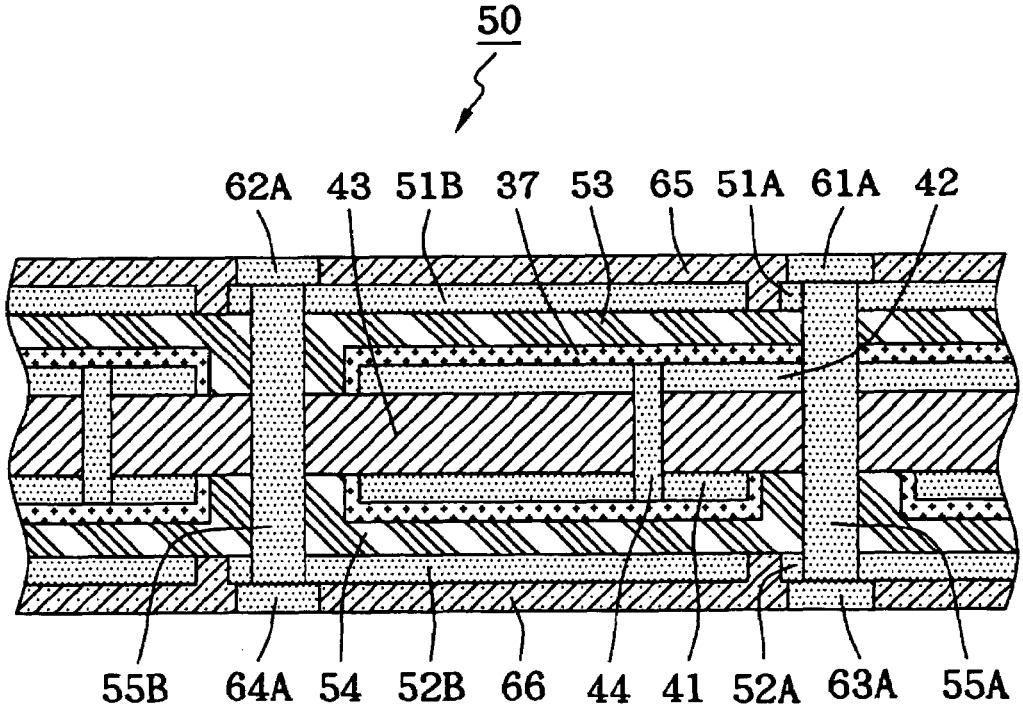
FIG. 14 is a cross-sectional view of still another manufacturing process of a circuit protection device of the second embodiment of the present invention.

Referring to FIG. 14, an uppermost first end electrode 61A, an uppermost second end electrode 62A, a bottommost first end electrode 63A, and a bottommost second end electrode 64A that can be weld are formed at the position of the first position 61 of the uppermost end electrode, the second position 62 of the uppermost end electrode, the first position 63 of the bottommost end electrode, and the second position 64 of the bottommost end electrode by screen printing with tin paste or electroplating tin and lead.

Figure 15:
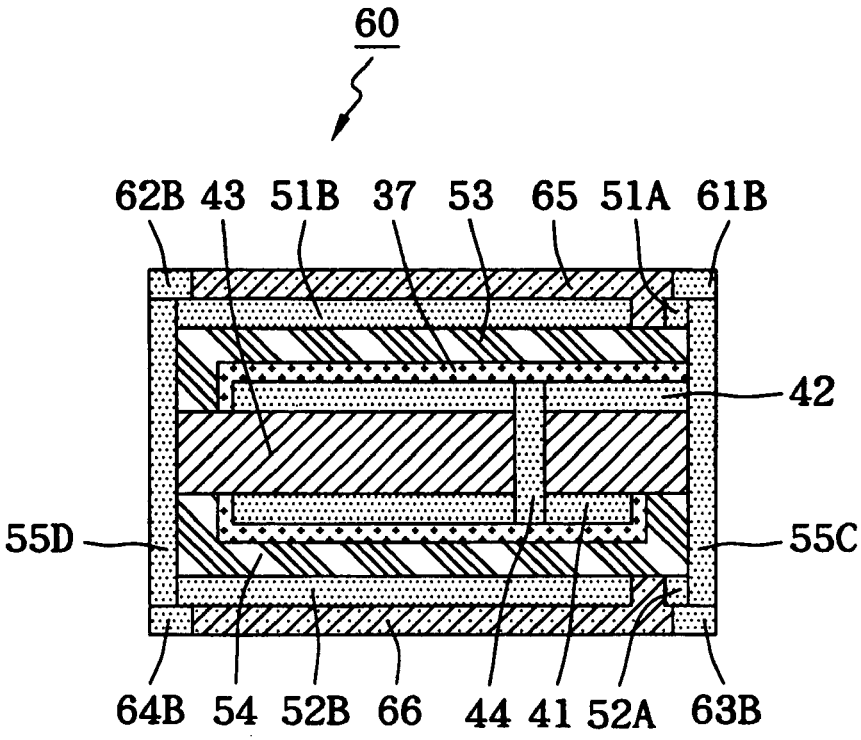
FIG. 15 is a circuit protection device of the second embodiment of the present invention.

After accomplishing all the processes described above, the multi-layer laminated circuit structure 50 is then diced from the middle positions of the first plated through hole 55A and the second plated through hole 55B using a diamond knife. Referring to FIG. 15, individual laminated circuit protection devices 60 are obtained. The second metal layer 42 conducts to the bottommost first end electrode 63B by a first plated through hole conducting mechanism 55C, while the uppermost second end electrode 62B conducts to the bottommost second end electrode 64B by a second plated through hole conducting mechanism 55D.

Figure 16:
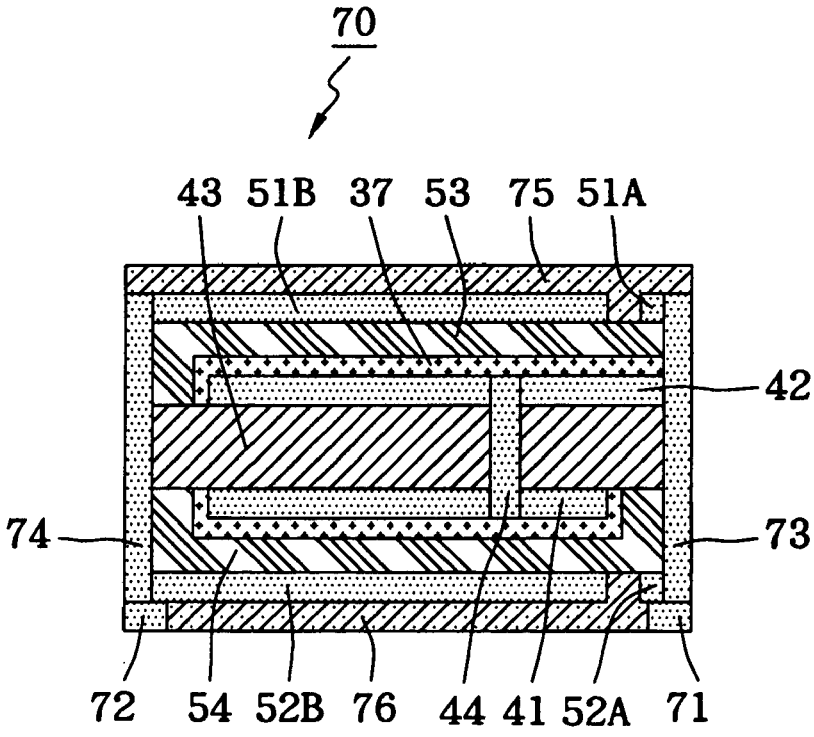
FIG. 16 is another circuit protection device of the second embodiment of the present invention.

Referring to FIG. 13 again, when it comes to preserving positions for forming the end electrodes, the producer can just leave the positions for end electrode at the surfaces of the third unit 52A of the bottommost metal electrode and the fourth unit 52B of the bottommost metal electrode; all the other areas including the uppermost isolation trench 58 and the bottommost isolation trench 59 are then coated by an insulating paint to form an insulating cover layer. After that, the end electrode is manufactured and the product diced; the result is another type of polymeric circuit protection device 70 of single face electrode as shown in FIG. 16.

Figure 17:
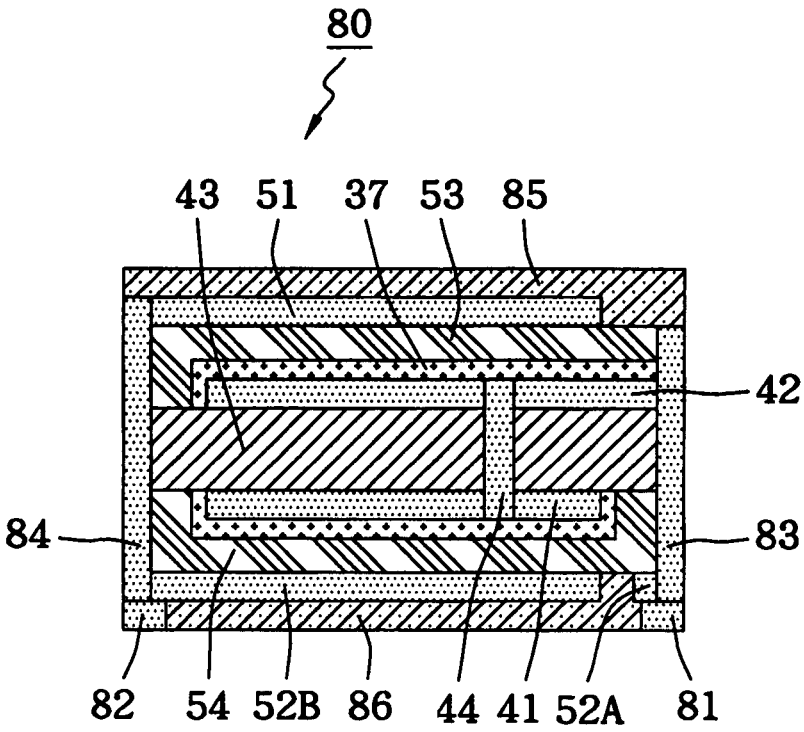
FIG. 17 is yet another circuit protection device of the second embodiment of the present invention.

Referring to FIG. 12 and FIG. 13 again, the uppermost metal electrode 51 and the bottommost metal electrode 52 of the multi-layer laminated circuit structure 50 are etched to eliminate some parts of metal electrode and thus form an uppermost isolation trench 58 and a bottommost isolation trench 59 that are not conductive; furthermore, the bottommost metal electrode 52 is divided into a third unit 52A of the bottommost metal electrode and a fourth unit 52B of the bottommost metal electrode by the bottommost isolation trench 59. When it comes to preserving positions for forming end electrode, producer can just leave the positions for end electrodes at the surfaces of the third unit 52A of the bottommost metal electrode and the fourth unit 52B of the bottommost metal electrode, all the other areas including the uppermost isolation trench 58 and the bottommost isolation trench 59 are then coated using insulating paint to form an insulating cover layer; after that, the end electrodes are manufactured and the product diced, the result is yet another type of polymeric circuit protection device 80 of single face electrode as shown in FIG. 17.

Figure 18:
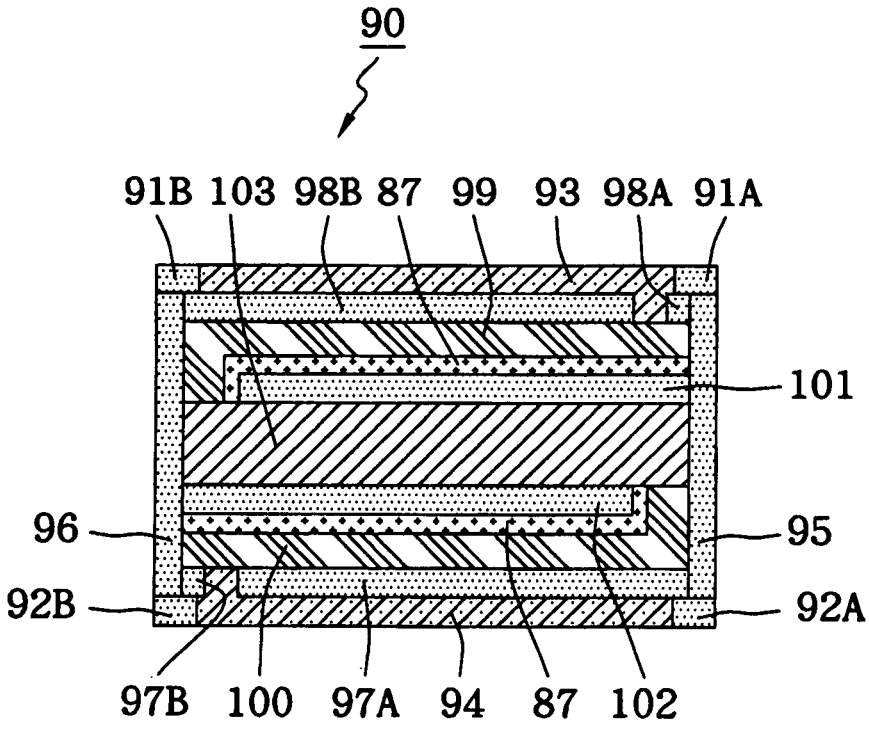
FIG. 18 is a circuit protection device of a third embodiment of the present invention.

FIG. 18 is a circuit protection device of a third embodiment of the present invention. As shown in FIG. 18, the present embodiment uses the same double-sided copper foil clad substrate as the second embodiment used, but without producing the plated through hole first for conducting the top and bottom electrodes of the double-sided copper foil clad substrate to each other. The producing procedures of the nickel electroplated copper foil and the conductivity composite material having PTC characteristics are the same as the procedures of the second embodiment. A parallel connection type of circuit protection device 90 functioning the same as the product in the second embodiment, it is main use a different internal circuit designs.

As described above, the employment of the double-sided metal foil clad substrate in the manufacturing method of the present invention makes it possible for the process to utilize the well-developed process used in printed circuit boards, and thus make the manufacturing of the laminated circuit protection device easier than the currently used continuous process applying soft metal foil roll; it also simplified the process to a remarkable degree.

Moreover, the surface mountable laminated circuit protection device provided by the present invention applies strengthened insulating layer in the double-sided metal foil clad substrate, giving the device better structural strength and dimensional stability.

Furthermore, because of the use of composite electroplating, the surface of the porous structure of the top metal layer contains carbon black already; when it comes to proceeding with the thermal laminating process, the conductive polymeric composite material with carbon black and the carbon black of the porous structure of the metal layer integrate tightly and thus form a well joint. Because of the tight integration of the conductive polymeric composite material with carbon black and the carbon black of the porous structure of the metal layer, the interfacial resistance between the metal electrode and polymeric composite material can be effectively reduced.

The technical contents and features of the present invention are disclosed on. However, anyone who is familiar with the technique could possibly make modifications or change the details in accordance with the present invention without departing from the technological ideas and spirit of the invention. For example, changing the polymeric material, adding different kinds of conductive particles, changing composite electroplating conditions or changing the weight ratio of the composite are within the protection scope of the present invention. The protection scope of the present invention should not be limited to what the embodiment discloses, it should include various modifications and changes that are made without departing from the technological ideas and spirit of the present invention, and should be covered by the claims mentioned below.

What is claimed is:

1. A method for manufacturing a surface mountable laminated circuit protection device, comprising the steps of:

providing a double-sided metal foil clad substrate comprising a first metal layer, a first insulating layer disposed on said first metal layer and a second metal layer disposed on said first insulating layer, wherein said first metal layer and said second metal layer are conducted to each other by a plated through hole which penetrates through said first insulating layer, said first metal layer is further divided into a first unit and a second unit, and said first unit and said second unit are separated and insulated from each other;

performing a composite electroplating process with carbon black to said second metal layer, so that a composite electroplated layer including carbon black and metal is formed on said surface of said second metal layer;

laminating a first conductive composite material having PTC characteristics and a metal foil onto said composite electroplated layer in sequence by a thermal laminating process for jointing said first conductive composite material having PTC characteristics and said second metal layer, wherein said metal foil is further jointed with said first conductive composite material having PTC characteristics, and a multi-layer laminated circuit structure thus is formed and said metal foil is taken as a third metal layer;

performing an isolating process to said third metal layer for forming a third unit and a fourth unit in said third metal layer; and setting a first conducting unit for conducting said third unit of said third metal layer and said first unit of said first metal layer, and further setting a second conducting unit for conducting said fourth unit of said third metal layer and said second unit of said first metal layer.

2. The method according to claim 1, wherein an etch process is performed to form a first isolation trench separating said first unit of said first metal layer and said second unit of said first metal layer.

3. The method according to claim 2, further comprising a step of filling said first isolation trench with an insulating material.

4. The method according to claim 1, further comprising a step for disposing a second conductivity composite material layer having PTC characteristics under said first metal layer.

5. The method according to claim 1, wherein the composite electroplating process is performed by using an electroplating solution comprising boric acid, carbon black and nickel.

6. The method according to claim 5, wherein the composite electroplating process is performed at approximately 35° C.

7. The method according to claim 5, wherein the composite electroplating process is performed for approximately 10 minutes.

8. The method according to claim 5, wherein the composite electroplating process is performed by using a current with a current density $3A/dm^2$.

9. The method according to claim 1, further comprising a cathode degreasing step with a solvent performed before the composite electroplating process, and the solvent is prepared by adding 60 grams of degreasing agent to 1 liter of deionized water.

10. The method according to claim 1, wherein the first conductive composite material is a conductive crystallized polymeric composite material filled with carbon black.

11. The method according to claim 1, wherein the first conductive composite material comprises a material selected from the group consisting of polyethylene, polypropylene, polyvinyl fluoride and copolymers.

* * * * *